United States Patent [19]

McCrady et al.

[11] Patent Number: 4,468,922

[45] Date of Patent: Sep. 4, 1984

[54] APPARATUS FOR SPINNING TEXTILE FIBERS

[75] Inventors: Paul E. McCrady, Columbus; Robert B. Reif, Grove City, both of Ohio

[73] Assignee: Battelle Development Corporation, Columbus, Ohio

[21] Appl. No.: 527,005

[22] Filed: Aug. 29, 1983

[51] Int. Cl.[3] ..... D01H 1/125

[52] U.S. Cl. ..... 57/402; 57/5

[58] Field of Search ..... 57/400–402, 57/5

[56] References Cited

U.S. PATENT DOCUMENTS

| | | | |
|---|---|---|---|
| 2,711,626 | 6/1955 | Oglesby, Jr. et al. | 57/402 |
| 3,107,478 | 10/1963 | Arshinov et al. | 57/402 |
| 3,411,284 | 11/1968 | Corbaz et al. | 57/402 |
| 3,664,110 | 5/1972 | Stalder et al. | 57/402 X |
| 3,665,695 | 5/1972 | Amato | 57/402 |
| 3,670,486 | 6/1972 | Murray, Jr. | 57/402 |
| 3,673,781 | 7/1972 | Breitenbach | 57/402 |
| 3,696,600 | 10/1972 | Mayer, Jr. et al. | 57/402 X |
| 3,768,243 | 10/1973 | Brown et al. | 57/402 |
| 3,945,185 | 3/1976 | Nakamura et al. | 57/402 |
| 4,002,016 | 1/1977 | Fischer et al. | 57/402 X |

*Primary Examiner*—John Petrakes

*Attorney, Agent, or Firm*—Benjamin Mieliulis

[57] ABSTRACT

An apparatus for electrostatic spinning of textile fibers is disclosed. The apparatus includes a twister electrode and a rapid spinning ground electrode, more particularly, a spinning ground electrode having an insulated tip which is tapered and fluted so as to positively drive or rotate the yarn tail extending from the twister electrode.

11 Claims, 3 Drawing Figures

APPARATUS FOR SPINNING TEXTILE FIBERS

This invention was made with USDA support and the U.S. Government has certain rights in the invention.

BACKGROUND OF THE INVENTION

1. Field of the Invention

This invention reveals an improved apparatus and process for textile spinning, specifically cotton spinning into uniform strong yarns. The disclosed apparatus improves upon electrostatic cotton spinning techniques and in particular improves rotary electrostatic spinning apparatus and processes.

This invention discloses the use of a twisting ground electrode opposite and in conjunction with a rotating conical collecting means having a high voltage twister electrode. The twisting ground electrode helps rotate the yarn tail extending from the twister electrode and electrostatically attaching to the twisting ground electrode.

2. Description of the Prior Art

In the process of becoming yarn, cotton is subjected to carding by which the entangled raw cotton fibers are teased into a more or less parallel alignment. The effect of carding on the cotton is to attenuate a comparatively thick lap of cotton to a gossamer-like film by drawing it out, combing the fibers and then bunching this thin film in a rope form commonly known as a sliver.

Typically the cotton sliver is then further passed through a number of drawing processes which mix the fibers and make them more parallel. In being led through the drawing processes, the sliver becomes drawn out and longer. Generally, to achieve mixing, several slivers are led together through the drawing process so as to yield a single corresponding longer sliver. For fine yarns, the sliver is optionally further combed.

The slivers next are led through special draw-frames and steadily reduced to a thickness of sliver suitable for spinning. Typically, the first of the special draw-frames has four pairs of rollers driven at increasing speeds. In this machine the slivers are mixed or combined and then attenuated by a process known as drafting. The sliver then is typically led through a slubbing frame in which it is drafted by the usual arrangement of pairs of rotating rollers, but on emerging from the last pair of rollers, the sliver is led through a flyer which slightly twists the sliver into an attenuated rope form known as roving and winds this roving onto a bobbin. The roving may then be processed through a roving frame to yield a roving of a degree of fineness and evenness such that it is ready for spinning most types of yarns. (*The Standard Handbook of Textiles* A. S. Hall, Neywood Books 1969, p. 122–123).

The ring-spinning process used in making yarns for more than one hundred years is based on inserting the spinning twist with the winding operation. The fibers pass from a roving into a spun yarn which is wound on a bobbin in a continuous path. The speed of the overall operation is limited by the mass of the bobbin. This limitation is removed in the more recent open-end spinning processes where the fiber flow is interrupted as it enters the spinning unit. Open-end spinning has a potential for much higher operating rates and for making yarn with fewer knots since bobbins can be larger.

Of the various open-end spinning processes, only rotor spinning has become a serious competitor to ring spinning. Although the rotor spinning machines provide higher production speeds, the yarn generally is not as uniform and is weaker than ring-spun yarn. In view of these factors and the higher cost of the more complex rotor spinning machines, the penetration of the new machines into the textile industry has been relatively small.

In the rotor-spinning process, the fibers are blown into the rotor which is a short open-end cylinder with a tapered inner wall. As the rotor spins, the fibers slip along the inner wall into a collecting groove. The condensed fibers are then twisted and drawn off through an outlet near the center of the rotor. The quality of yarn and the operating speed are limited by the slippage of the yarn in the rotor and the accumulation of trash in the collecting groove.

The best yarns are made with narrow collecting grooves that are especially sensitive to trash accumulation. Elimination of the collecting grooves is desirable but another method for controlling the fibers is then needed to provide a high quality yarn at high production rates.

Electrostatic forces provide such an alternative to fiber control by narrow collecting grooves. Electrostatic spinning of yarn has been developed as an open-end spinning process. Generally, an electrostatic field is applied between a fiber supply roll and a spinning device. The fibers are charged by induction as they enter the electrical field at the supply roll and are attracted to previous fiber forming a yarn tail and extending from a twister electrode or twisting gripper electrode. Efforts at commercialization of open-end electrostatic spinning have failed to reach competitive or economical production rates. The electrostatic processes have failed because of undesirable reverse twist which produced instability in the free tail of the yarn during twisting by the twister electrode. The reverse twist increases with the spinning speed causing loss of tensile strength and frequent breaks in the yarn at high production speeds.

In the electrostatic spinning process as described by Corbaz, U.S. Pat. No. 3,411,284, roving fibers are charged by induction as they emerge through a pair of rubber and steel delivery rolls. The electrical field is used to align and propel the fibers to the collecting means which is rotated to twist successive fibers into a thread within the collecting means. A tail of the new yarn is formed at the twister or twisting gripper electrode where twist is imparted, and said tail extends to contact the lower portion of the steel delivery roll.

A problem in the prior art has been that, inherently, the end of the long tail extending from the twisting means fails to twist with the yarn in the twister electrode. Therefore, a reverse twist forms in the portion of the tail between the twister electrode and the metal feed roll. Some of the reverse twist eventually is removed as the yarn advances through the twister electrode, but the amount of twist inserted in the formed yarn is reduced, hence yarn strength is reduced. Moreover, visible nodes form in the tail as the yarn attaches and detaches from the metal feed roll and yarn uniformity varies as the tail shifts on the feed roll. Due to these inherent problems, electrostatic spinning has not been widely accepted for high speed commercial spinning.

U.S. Pat. No. 3,768,243 (Brown) described an electrostatic apparatus comprising a stationary electrode element with a tubular projection, a relatively large disc-shaped rotary electrode element and an independently rotating spindle element assembly with a sharp-edged fiber collecting ring. At higher speeds, however, centrifugal effects throw the yarn tail off the fiber collecting ring interrupting the spinning process. Other patents such as U.S. Pat. Nos. 3,696,603 (Kotter) and 4,040,243 (Weller) were attempts to twist the yarn tail and the body of the yarn at the same time using a twisting member which is longer than the basic fiber length, however, both have the drawback that at higher speeds, the fibers sheathing the long twisting member tend to flair from the long twisting and collecting member. The long twisting member does not uniformly release the fibers therefore the fibers come off in surges.

U.S. Pat. No. 4,002,016 (Fischer) described an attempt to use a nonrotatable needle mounted in an electrical insulator to impinge upon the path of travel of fibers being fed to the rotor or twister. Fischer references (column 1, paragraph 3) an unsuccessful apparatus which utilized a rotating fiber brush opposite the rotating yarn end. The Fischer improvement disclosed is an apparatus which includes a nonrotatable needle. The needle is to serve to hold the yarn tail from corotating with the twister. At higher speeds in electrostatic processes the Fischer design would give rise to reverse twist forming in the yarn tail causing the yarn tail to attach and detach from the needle therefore forming visible nodes in the finished yarn. Fischer, while recognizing the problem of false twist in mechanical spinning processes (column 2, line 39), does not address the problem of false twist in electrostatic processes. The Fischer nonrotatable needle would enhance the problem of false twist in the yarn tail in electrostatic processes. The present invention obviates the problem of reverse twist in electrostatic processes.

SUMMARY OF THE INVENTION

The present invention is an improved electrostatic spinning process which employs an auxiliary ground electrode which spins on its axis in addition to a twister electrode operating on the yarn tail. Said ground electrode or auxiliary ground electrode or twisting ground electrode (terminology is interchangeable) in the form of a rounded tube or rod is positioned below or proximate to the metal feed roll such that the yarn tail extending from the twister electrode will attach to the auxiliary ground electrode rather than to the feed roll. The auxiliary ground electrode is spun at the same speed and in the same direction as the twister electrode so that the yarn tail formed between the twister electrode and auxiliary ground electrode is encouraged to rotate in the same direction as the newly formed yarn is twisted, thereby reducing or eliminating the reverse twist, reducing the instability of the tail, and increasing the uniformity and strength of the yarn spun. The terms spinning and twisting are used synonymously herein. Advantageously, the auxiliary ground electrode or twisting ground electrode includes a nylon tapered fluted tip to positively drive or rotate the yarn tail. In a preferred embodiment, said auxiliary ground electrode with tip made of insulating material are both made hollow to, additionally to the electrostatic forces, enable vacuum attraction of the fibers fed from the feed roll to the tail extending from the twister electrode. The preferred embodiment is especially compatible with card type feeders.

DETAILED DESCRIPTION OF INVENTION

Figure 1:
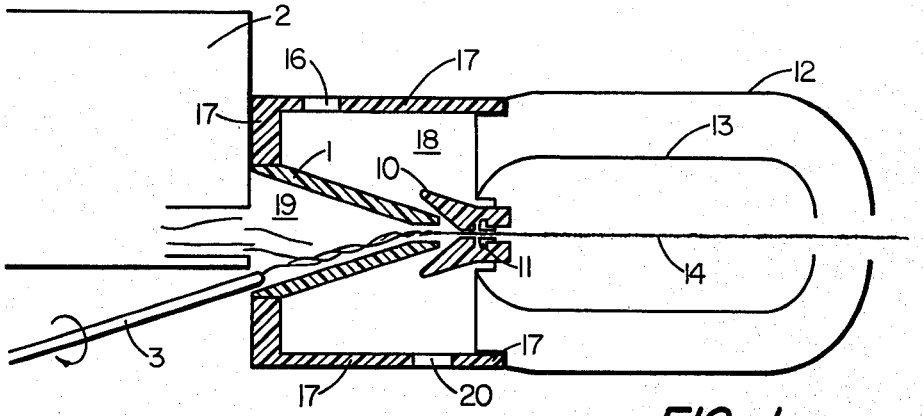
FIG. 1 is a side sectional view of an electrostatic spinning apparatus according to the present invention.

FIG. 1 depicts a card and auxiliary ground electrode, which is spun, positioned at the base of two conical shaped members. The conical members define a chamber in which the yarn is formed. In electrostatic processes, the yarn tail is the fiber collecting means. It is important to have, between the card and the twister electrode, tapered walls so that the electrical field lines at the walls direct fibers to the yarn tail extending from the twister electrode. The tapered walls preferably are formed of two, slightly spaced apart, conical members of insulating material, one stationary and one rotating. The rotating conical member at its apex fits over the twister electrode which is understood to include a gripper well known in the art for gripping and twisting the fiber to impart twist. The rotating conical member and twister electrode are spun in the same direction perferably at substantially identical speeds.

In FIG. 1 rotating conical member 10 of electrically insulating material, covering twister electrode 11, and twister electrode 11 are both rotated by spinner motor 13. Shield 12 houses the spinner motor. An axial bore through spinner motor 13 provides a passageway for yarn 14 to travel through and exit from the spinner motor. A stationary conical member 1 made of insulating material is spaced from the rotating conical member 10. A card 2 for feeding prealigned fibers and having a fiber exit feeds fibers to the base of the stationary conical member 1. Space is provided next to card 2 to permit positioning of auxiliary ground electrode 3 near the card exit and at the base of stationary conical member 1. Stationary conical member 1 spaced from rotating conical member 10 is enclosed by housing 17 so as to form inner chamber 19 and outer chamber 18. A suction means (not shown) can be attached to housing 17 at opening 20 to draw air through air inlet 16 and to evacuate air from outer chamber 18 and from inner chamber 19 through the space provided between conical members 1 and 10 thus providing an additional means of attracting fibers to the rotating conical member 10 while also providing a means of cleaning stray fiber from stationary conical member 1 and rotating conical member 10.

Figure 2:
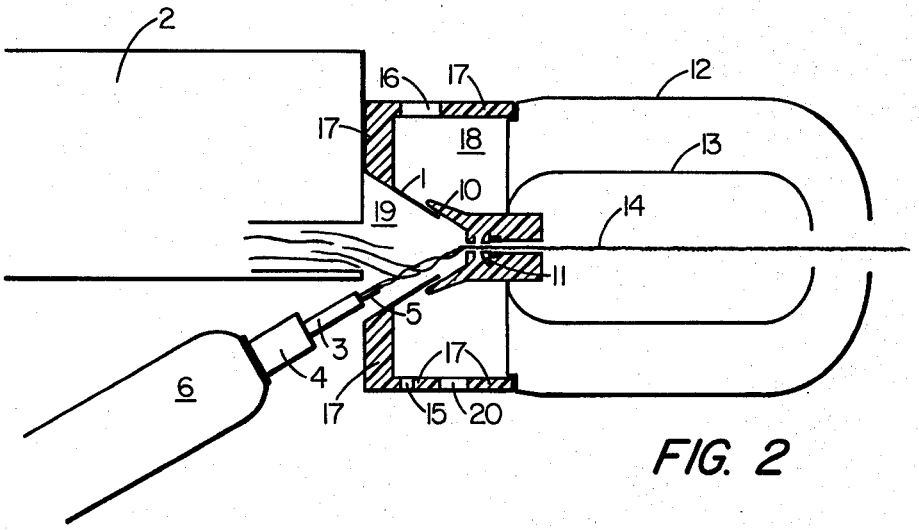
FIG. 2 is a preferred embodiment of the configuration of FIG. 1 depicting one preferred design for the auxiliary ground electrode or twisting ground electrode.

FIG. 2 shows a design similar to the electrostatic spinning apparatus of FIG. 1 with optional air inlet 15 in addition to air inlet 16 which can be used to facilitate stray fiber removal by vacuum means through opening 20. Additionally, auxiliary ground electode 3 is shown mounted on a bushing 4 and spun by spinner motor 6. More importantly auxiliary ground electrode 3 is shown with tip 5 made of insulating material and tip 5 is preferably fluted to aid in rotation of the yarn tail.

Figure 3:
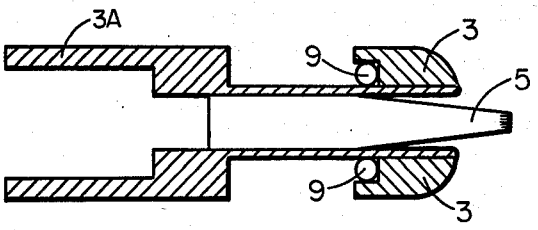
FIG. 3 is an enlarged side sectional view of another preferred design for the auxiliary ground electrode or twisting ground electrode.

FIG. 3 is a close up of a preferred design for the auxiliary ground electrode. Auxiliary ground electrode 3 is held in place by O-ring 9 depicted as a press-fit element slipped onto conductive element 3A. Tip 5 made of insulating material is press fitted and held in place in a receptive boring in conductive element 3A. Tip 5 is conical in shape and is both tapered and then fluted on the end. The base of element 3A is conveniently designed to mate with a receptive bushing of a spinner motor.

DESCRIPTION OF THE PREFERRED EMBODIMENTS

In the electrostatic spinning of fibers by this invention, a high voltage potential is applied between a twister electrode and an auxiliary ground electrode. A yarn tail, formed from immediately preceding fibers fed into the electrical field between said electrodes and twisted by the twister electrode, extends from said twister electrode to the auxiliary ground electrode. Both the twister electrode and auxiliary ground electrode rotate in the same direction. A rotating conical member at its apex houses the twister electrode and also rotates in the same direction as the twister electrode and auxiliary ground electrode.

Fibers are individualized and/or prealigned by any well known card type feeder and through an exit in the card type feeder are fed into the base of a stationary conical member spaced slightly from said rotating conical member thus forming an air gap between the two conical members. The fibers are attracted to the yarn tail extending from the twister electrode. The yarn tail, being continually added to by newly attracted and attached fibers, is continuously pulled through the twister electrode wherein a gripper imparts twist to make yarn. A suitable wind up device or means for collecting the yarn provides the pull to draw the yarn tail into the twister electrode.

In the preferred embodiment, fiber from a roving or sliver is individualized with a card type feeder and through a slot opening of the card feeder are delivered into the base of a conical forming chamber. Fibers are charged by induction-conduction as they leave the card and are attracted to the tail of the yarn which extends from the twister electrode located at the apex of the rotating conical member to the auxiliary ground electrode. The twister electrode grips and spins the fibers into yarn. The newly formed yarn is collected and wound by means of a suitable winding device.

An electrical field is applied between the twister electrode which includes a gripping device and which spins at high speed to twist the fibers into yarn, and the auxiliary ground electrode which also spins and is located near the card at the base of the stationary conical member.

The voltage potential between said twister electrode and said auxiliary ground electrode or twisting ground electrode induces a charge on the fiber being fed from the card which attracts the fibers to the yarn tail extending back from said twister electrode.

For a staple fiber of about 1½ inches fiber length, the twister electrode is spaced about ⅝–1 inch from the auxiliary ground electrode and potentials of about 30 kv are applied. The yarn tail passes through a hole, about 3/16th of an inch in diameter, at the apex of the stationary conical member. The apex of the stationary conical member is spaced from a rotating conical member which at its apex houses the twister electrode. The spacing apart of the conical members forms an air passage leading to an outer chamber which is evacuated to remove fiber fragments and dirt. For high-speed operation, the auxiliary ground electrode is spun at essentially the same speed as the rotating conical member and twister electrode to stabilize the yarn tail. Differential speeds can also be advantageously used. To provide better attachment of the yarn tail to the auxiliary ground electrode a small plastic cone or fluted tip is advantageously used on the end of the auxiliary ground electrode. The fluting enables the auxiliary ground electrode to more positively drive or rotate the yarn tail by improving attachment of the yarn tail to the auxiliary ground electrode.

A preferred design for the plastic tip or cone comprises a tapered Teflon®, nylon, or plastic rod with tapered flutes at the free end. The auxiliary ground electrode is preferably cylindrical but rounded at the free end and has an axial bore or socket in the free end. The tapered plastic rod is supported in the socket in the free end of the auxiliary ground electrode made of metal which electrode is of slightly larger diameter. In practice, the tail of the newly formed yarn slips off the tapered plastic rod but the flutes provide a more positive drive or improved attachment to assure that the yarn tail turns with the auxiliary ground electrode which twists or spins.

Rounded especially when referring to the preferably rounded end of the auxiliary ground electrode or twisting ground electrode is understood in this invention and in the claims to be an equivalent of chamfer, ogee or similar artistic curvature variations.

In another preferred design for said plastic tip and twisting ground electrode, said twisting ground electrode with said plastic tip (preferably conical and fluted), for driving the yarn tail, are made hollow or with an axial passageway. Centrifugal effects can become significant even on small diameter textile fibers when twisting speeds exceed 20,000 rpm. A hollow conical twisting ground electrode can advantageously have a suction means to evacuate air from the conical forming chamber to draw the fibers toward the twisting ground electrode. In this way air in the forming chamber flows toward the twisting ground electrode, carries fibers in the desired direction toward the yarn tail, and draws the ends of the fibers near or into the hollow twisting ground electrode. Beneficially this arrangement using a hollow twisting ground electrode in practice reduces the diameter of the fiber bundle of the yarn tail and reduces the effects of centrifugal force on the fibers in the bundle at the twisting ground electrode, thereby improving overall finished yarn quality.

Where vacuum evacuation of the outer chamber 18 for cleaning is provided, then of course it would be evident to those skilled in the art that the relative rates of evacuating air from the outer chamber and/or through the hollow twisting ground electrode for fiber attachment would need to be adjusted and balanced for optimum performance according to each intended function.

The stationary conical member is made of electrically insulating material and is positioned to be in substantial axial alignment with the discharge outlet of the fiber feed means, preferably a card type feeder. The base of the stationary conical member is oriented to receive fibers from the fiber feed means.

The stationary conical member leads to the rotating conical member. The rotating conical member is likewise made of electrically insulating material and is positioned to be in substantial axial alignment with the stationary conical member and the discharge outlet of the fiber feed means. The rotating conical member is spaced from the stationary conical member so as to leave an air gap enabling vacuum evacuation of stray fibers and scrap.

Preferably the stationary conical member is open-ended, however, it is readily apparent that the base of said conical member can be covered but with an opening provided to receive fibers from the card. The twisting ground electrode then can be located in the same or a different opening, or just as readily, machined into or designed in the base.

Preferably, the twister electrode spins or twists simultaneously with the rotating conical member. The twister electrode well known in the art is understood to include a gripper designed to impart spin to the fibers passing through an axial bore in the twister electrode.

The stationary conical member and rotating conical member with twister electrode are housed in a housing having openings to which air evacuation means can be attached. An air inlet can be included in the housing to further facilitate stray fiber removal or evacuation through one or more of the other openings.

It has been found that optimum results are obtainable with the axis of the twisting ground electrode and the axis of the twister electrode oriented in a manner to be coaxial, but the apparatus will operate effectively with a significant angle between the axes. In some prototype trial runs, the twisting ground electrode was positioned next to the fiber delivery slot with the axis of the twister electrode and yarn path at about 45° to the direction in which the fibers emerge from the slot of the card feeder.

In the laboratory prototype model the stationary conical member had sides angled at 30° from the center line. The stationary conical member opening in the apex measured 0.530". The rotating conical member was cut to have sides matching the 30° angle of the stationary conical member. Wall thickness of the rotating conical member in front of the twister electrode measured approximately 0.025". The distance from the card fiber exit to the apex of the funnel-shaped forming member measured ⅝"–1½". The twisting ground electrode measured approximately ¼" in diameter and had a tapered and fluted Teflon® tip approximately ⅛" in diameter and extending approximately ¼"–½" beyond the free end of the twisting ground electrode. Six grooves 20 mils deep at the tip or end formed the flutes. The taper was approximately 4°. With this prototype configuraion yarn was spun at speeds up to 100 feet per minute while the yarn was twisted at 60,000 rpm and roving was fed into the system at 3 feet per minute. It is understood, of course, by those skilled in the art that production dimensions would not necessarily be expected to conform to the dimensions of the laboratory prototype model. Significantly, the first two drawings herein approximate actual size of a functional prototype demonstrating feasibility of and potential for very compact commercial units.

It will be understood, of course, that while the form of the invention herein shown and described constitutes the preferred embodiments of the invention, it is not intended herein to illustrate all of the possible equivalent forms or ramifications of the invention. Multiplication of certain of the elements such as the conical members is a readily apparent equivalent form. The term "conical" when referring to any of the conical members is understood in this invention and in the claims to include and be equivalent to cones, half-spheres and other similar artistic variations which would taper toward the twister electrode. It will also be understood that the words used are words of description rather than of limitation, and that various changes, such as changes in shape, relative size, and arrangement of parts may be substituted without departing from the spirit or scope of the invention herein disclosed.

What is claimed is:

1. An electrostatic spinning apparatus for spinning textile fibers comprising:
   - a fiber feed means having an exit for discharging textile fibers therefrom;
   - a stationary conical member of electrically insulating material having an opening in the base for receiving fibers from the exit of said fiber feed means and an open-ended apex for passage of said fibers therethrough;
   - a rotating conical member of electrically insulating material spaced from said stationary conical member but having an open-ended base aligned therewith for receiving fibers passing through said stationary conical member;
   - a twister electrode at the apex of said rotating conical member for receiving fibers from said rotating conical member, for twisting said fibers into continuous yarn, but forming a trailing end of fibers into a yarn tail;
   - a twisting ground electrode proximate the fiber feed means exit and the base of said stationary conical member for reducing or eliminating reverse twist in said yarn tail extending from said twister electrode;
   - an electrical field between said ground electrode and said twister electrode produced by a voltage source so as to produce an electrical charge on fibers entering into said electrical field.

2. The apparatus according to claim 1 wherein said twisting ground electrode includes in addition a fluted tip of insulating material said tip having a diameter less than the diameter of said twisting ground electrode.

3. The apparatus of claim 1 wherein said twisting ground electrode has a rounded free end and includes in addition thereat a tapered and fluted tip of insulating material of smaller diameter than the diameter of said electrode at said free end.

4. The apparatus according to claim 3 wherein said twisting ground electrode with tip of insulating material has in addition an axial passageway throughout and an attached vacuum means to draw fibers toward said twisting ground electrode.

5. The apparatus according to claim 1 wherein said twisting ground electrode is comprised of an axially-bored cylindrical electrode having a rounded free end,
   - said electrode housing in its axial boring a tapered and fluted tip of insulating material,
   - said fluted tip extending beyond the rounded free end of said electrode.

6. The apparatus according to claim 1 wherein said twisting ground electrode includes an axial passageway and attached vacuum means to draw fibers toward said twisting ground electrode.

7. The apparatus according to claim 1 wherein the rotating conical member, the twister electrode, and the twisting ground electrode all spin in the same direction.

8. The apparatus according to claim 7 wherein the rotating conical member, the twister electrode, and the twisting ground electrode spin at substantially the same speed.

9. A method of spinning textile fibers comprising the steps of:
   - (a) applying a high voltage potential between a twister electrode and a twisting ground electrode;

(b) delivering by fiber feed means textile fiber into an electrical field between said twister electrode and said twisting ground electrode, said electrodes located on opposite sides of a chamber defined by two or more electrically insulating conical members;

(c) electrically charging said fibers whereby said charged fibers are aligned toward and propelled in the direction of said twister electrode;

(d) twisting the fibers with said twister electrode to form a yarn beyond said twister electrode and to form a yarn tail extending from said twister electrode back to said twisting ground electrode said yarn tail becoming a fiber collecting means;

(e) twisting said yarn tail with said twisting ground electrode so as to reduce or eliminate reverse twist by twisting said ground electrode in the same direction as said twister electrode.

10. The method according to claim 9 comprising the additional step of:

rotating, in the same direction as the twister electrode, the electrically insulating conical member nearest the twister electrode to assist in directing fibers to said twister electrode.

11. The method according to claim 10 wherein said electrically insulating conical member, said twister electrode, and said twisting ground electrode are rotated at substantially identical speeds.

* * * * *